US008061438B2

(12) United States Patent
Schmid et al.

(10) Patent No.: US 8,061,438 B2
(45) Date of Patent: Nov. 22, 2011

(54) HAND-HELD POWER TOOL WITH A VIBRATION-DAMPED HANDLE

(75) Inventors: Lars Schmid, Nuertingen (DE); Johannes Schnitzler, Reutlingen (DE); Gerhard Meixner, Filderstadt (DE); Juergen Lennartz, Ostfildern (DE); Jan Koalick, Leinfelden (DE)

(73) Assignee: Robert Bosch GmbH, Stuttgart (DE)

( * ) Notice: Subject to any disclaimer, the term of this patent is extended or adjusted under 35 U.S.C. 154(b) by 152 days.

(21) Appl. No.: 12/094,458

(22) PCT Filed: Apr. 5, 2007

(86) PCT No.: PCT/EP2007/053352

§ 371 (c)(1), (2), (4) Date: May 21, 2008

(87) PCT Pub. No.: WO2007/128634

PCT Pub. Date: Nov. 15, 2007

(65) Prior Publication Data

US 2008/0283261 A1 Nov. 20, 2008

(30) Foreign Application Priority Data

May 8, 2006 (DE) ..... 10 2006 021 307

(51) Int. Cl.
*B25D 17/04* (2006.01)

(52) U.S. Cl. ..... 173/162.2; 173/90

(58) Field of Classification Search ..... 173/162.1, 173/162.2, 90, 200, 210, 211
See application file for complete search history.

(56) References Cited

U.S. PATENT DOCUMENTS

| | | | | |
|---|---|---|---|---|
| 3,322,211 | A * | 5/1967 | Alabuzhev et al. | 173/162.2 |
| 4,673,043 | A * | 6/1987 | Greppmair | 173/162.2 |
| 4,921,053 | A * | 5/1990 | Dobry et al. | 173/162.2 |
| 5,025,870 | A | 6/1991 | Gantner | |
| 7,076,838 | B2 | 7/2006 | Meixner | |
| 7,287,601 | B2 | 10/2007 | Hellbach et al. | |
| 2003/0037937 | A1 * | 2/2003 | Frauhammer et al. | 173/48 |
| 2003/0132016 | A1 * | 7/2003 | Meixner et al. | 173/162.2 |
| 2004/0040729 | A1 * | 3/2004 | Meixner | 173/162.2 |
| 2004/0231867 | A1 | 11/2004 | Becht et al. | |
| 2005/0263307 | A1 * | 12/2005 | Stirm et al. | 173/162.2 |
| 2006/0011365 | A1 * | 1/2006 | Stirm et al. | 173/162.2 |

FOREIGN PATENT DOCUMENTS

| | | |
|---|---|---|
| DE | 41 04 917 | 8/1992 |
| DE | 101 38 123 | 2/2003 |
| DE | 10 2004 019 776 | 11/2005 |
| EP | 0 370 952 | 5/1990 |
| EP | 1 529 603 | 5/2005 |
| WO | 03/011532 | 2/2003 |

* cited by examiner

*Primary Examiner* — Paul Durand
(74) *Attorney, Agent, or Firm* — Michael J. Striker

(57) ABSTRACT

The invention relates to a hand tool machine (2), in particular a drilling and/or percussion hammer, with a housing (4) and a vibration-damped handle (10) elastically supported relative to the housing (4) with two essentially parallel legs (20, 22) and a coupling element (44 or 46) between each leg (20 or 22) and the housing (4) that is pin-jointed to the leg (20 or 22) and the housing (4). The coupling elements (44, 46) are connected to each other by a connector (48) that synchronizes the movements of the coupling elements (44, 46).

9 Claims, 4 Drawing Sheets

HAND-HELD POWER TOOL WITH A VIBRATION-DAMPED HANDLE

CROSS-REFERENCE TO RELATED APPLICATION

The invention described and claimed hereinbelow is also described in German Patent Application DE 10 2006 021 307.6 filed on May 8, 2006. This German Patent Application, whose subject matter is incorporated here by reference, provides the basis for a claim of priority of invention under 35 U.S.C. 119(a)-(d).

BACKGROUND OF THE INVENTION

The present invention relates to hand-held power tool, in particular a rotary hammer and/or a percussion hammer, with a housing and vibration-damped handle that is spring-supported against the housing.

With hand-held power tools with an impact drive in particular, such as rotary hammers, chisel hammer, and the like, the hand-held power tool may be subjected to considerable vibrations. When these vibrations are transferred to a handle that is used to press the hand-held power tool against a work piece, the operator perceives the vibrations to be uncomfortable, and long-term exposure thereto may even result in injury. For this reason, double-shelled housings, with which the entire hammer is suspended in an outer shell such that it is resilient in the working direction, have been used to provide linear vibration damping of rotary hammers. This design is relatively complex and expensive, however.

Publication WO 03/011532 makes known a machine tool of the type described initially, which includes a vibration-damped, C-shaped handle that supported via springs against the housing. This handle includes two essentially parallel legs, which are guided into complementary recesses in a grip end of the housing in the working direction of the machine tool such that they are linearly movable. To ensure that the two legs do not tilt in the recesses and then move in a synchronous manner with each other relative to the housing when the operator applies a compressive force to the handle on only one side or not parallel to the working direction of the machine tool, the two legs are connected with the housing via a lever, the outer ends of which are hingedly connected to the particular legs, while their inner ends are hingedly connected to a region of the machine housing located between the two legs of the handle. Since there is no direct connection between the handle and the housing of the machine tool, a good decoupling of the handle from the vibrating housing is attained. The lever design also increases the stability of the handle.

In addition, publication DE 10 2004 019 776 A1 has also already made known to hingedly connect the two legs of a handle of a machine tool with the housing of the machine tool, to dampen vibrations using coupling elements.

In addition, a machine tool with a vibration-damped handle is made known in DE 101 38 123 A1, with which one of the coupling elements that is hingedly connected with the handle and the housing is accommodated inside the hollow handle in a space-saving manner, and the other is accommodated inside the housing.

While these designs make it possible to attain satisfactory vibration damping and decoupling of vibrations, it is not always possible to integrate these designs in the housing and/or the handle, or to accommodate them inside the housing and/or the handle such that they take up a small enough space in the working direction of the machine tool that they do not result in an increase in the overall length of the machine tool.

SUMMARY OF THE INVENTION

Based thereon, the object of the present invention is to improve a machine tool of the type described initially such that the components required to decouple vibrations from the handle may be accommodated inside the housing and/or the handle in a space-saving manner, and, in particular, such that they require very little space in the working direction of the machine tool, thereby making it possible to reduce the overall length of a grip region of the machine tool—which is composed of the handle itself and a part of the machine tool housing used to accommodate the legs of the handle, the coupling elements, and the spring—to the greatest extent possible.

In keeping with these objects and with others which shall become apparent hereinafter, one feature of the present invention resides, briefly stated, in that the coupling elements are interconnected via a connecting element that synchronizes the motions of the coupling elements.

The present invention is based on the finding that the space required by the components designed to decouple vibrations from the handle may be kept very small when the motions of the two legs of the handle are not synchronized by the coupling elements themselves, but rather by an additional connecting element between the coupling elements, which is hingedly connected only to the two coupling elements, and is not connected with the housing or the handle. In this manner, the shape of the coupling elements may be better adapted to the space available in the grip region of the machine tool, thereby making it possible to provide a compact, cost-favorable design.

According to a preferred embodiment of the present invention, the connecting element is designed as a connecting rod, the opposing ends of which are advantageously hingedly attached to the coupling elements such that the connecting rod is oriented essentially transversely to the working direction of the machine tool, which contributes to a reduction in the overall length.

According to a particularly space-saving version, the connecting element and parts of the coupling elements are located inside the hollow, C-shaped handle, thereby making it possible to move some of the required components out of the housing of the machine tool. The two coupling elements advantageously extend through the open ends of the legs of the C-shaped handle and into the interior of the handle, where they are coupled by the connecting element, which advantageously extends through the hollow yoke of the handle.

In this case, at least one coupling element is advantageously designed as a two-armed lever, whose one lever arm is hingedly connected with the housing, and whose other lever arm is hingedly connected to the connecting element inside the hollow handle, the lever between the two lever arms being hingedly connected with a leg of the handle. Advantageously, the other coupling element is also designed as a two-armed lever, whose one lever arm is hingedly connected with a leg of the handle, and whose other lever arm is hingedly connected to the connecting element inside the hollow handle, while the lever itself between the two lever arms is hingedly connected to the housing.

As an alternative, at least one coupling element may be designed as a disk that is pivotably connected at its center with the housing and that, at a distance from its center, is hingedly connected with one of the legs and the connecting element. The springy support of the handle against the housing is advantageously achieved using a compression spring located between the handle and the housing, and which is preferably located next to the two legs along at least a portion of its length.

BRIEF DESCRIPTION OF THE DRAWING

The present invention is described in greater detail below with reference to an exemplary embodiment shown in the drawing.

DESCRIPTION OF THE PREFERRED EMBODIMENTS

Figure 1:
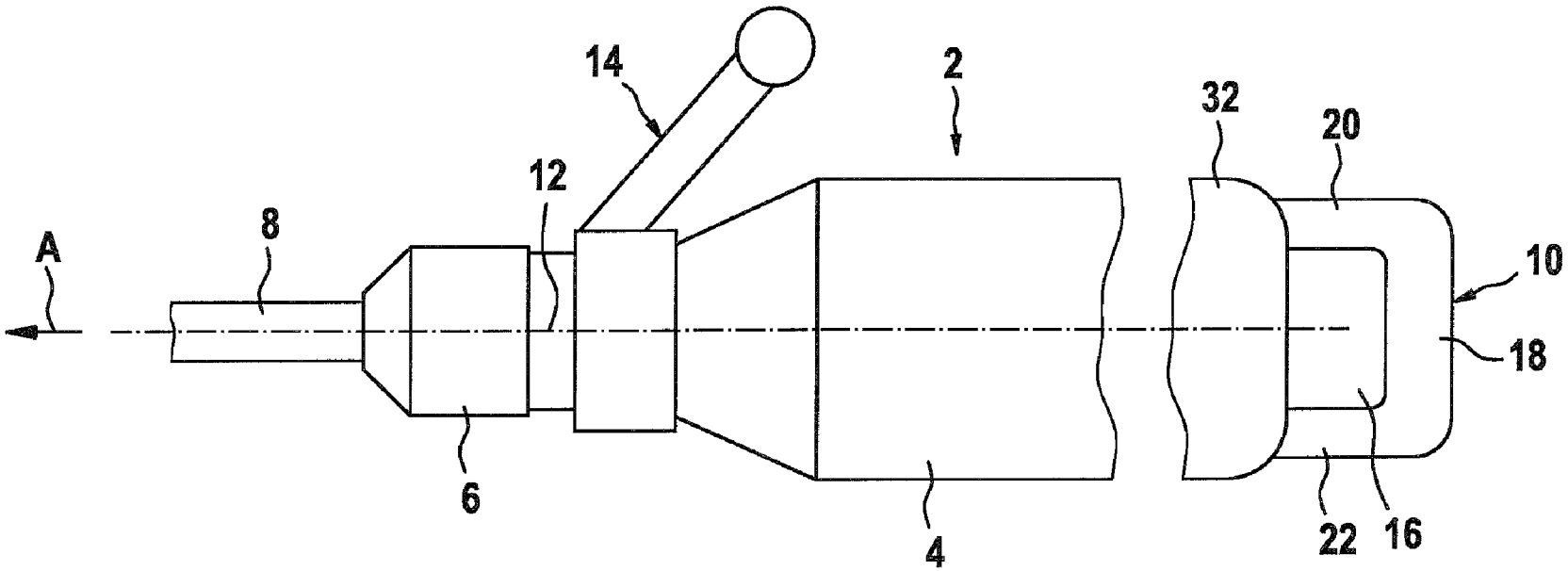
FIG. 1 shows a simplified, schematic side view of a hand-held power tool.

Hand-held power tool 2, which is depicted schematically in FIG. 1 and is designed as a rotary hammer or a percussion hammer, is essentially composed of a housing 4, a tool holder 6 for accommodating a tool 8, and a drive device (not shown) enclosed by housing 4 that drives tool 8 installed in tool holder 6 in a rotating and/or percussive manner.

The drive device is composed—in a known manner—of an electric drive motor that drives tool holder 6 via reduction gears and a transmission in a rotating manner, and an impact mechanism that is also driven by the drive motor, and with which tool 8 in tool holder 6 may be acted upon with an impact force that acts in a working direction A of machine tool 2.

Housing 4 is provided with a C-shaped handle 10 on its end face that faces away from tool holder 6. C-shaped handle 10 is used—together with an additional handle 14 detachably installed near tool holder 6 or 12—to grip and hold machine tool 2. Together with housing 4, C-shaped handle 10, which extends beyond housing 4, encloses a grip opening 16 for a hand of an operator and makes it easier for him to hold and guide machine tool 2, particularly during vertical operation, i.e., in vertical working direction A and with tool 8 oriented downward, while additional handle 14 is used mainly when working direction A is oriented horizontally or flat.

As shown best in FIGS. 2 through 7, C-shaped handle 10 is composed mainly of a yoke part 18 and two legs 20, 22, which are parallel to working direction A of machine tool 2, the free ends of which extend through two openings 24, 26—located adjacent to each other, with distance between them—in a wall part 28 of housing 4 that bounds grip opening 16 toward the front, and into a chamber 30 inside a grip region 32 of housing 4 that faces away from tool holder 6.

Chamber 30, which is enclosed by housing 4, contains a helical compression spring 34 located between a part of C-shaped handle 10 and housing 4, and at least a portion of which is preferably located next to legs 20, 22. Spring 34 presses C-shaped handle 10—when in the unloaded state—backward into a rear end position (FIGS. 2, 4, and 6), in which rear-facing stop surfaces 36 on legs 20, 22 of C-shaped handle 10 come in contact with complementary stop surfaces 38 of housing 4 that face forward, in working direction A, stop surfaces 38 being formed around openings 24, 26 on the inner side of wall part 28. When a compressive force is applied to C-shaped handle 10—as indicated by arrow F—by the operator's hand when tool 8 is pressed against a work piece, C-shaped handle 10 is pressed against the force of spring 34 in working direction A. When spring 34 is compressed in a front end position (FIGS. 3, 5, and 7), C-shaped handle 10 comes in contact via the front end faces of legs 20, 22 with a stop surface 40 that is perpendicular to the working direction, stop surface 40 being formed by an inner boundary wall 42 of chamber 30 that is parallel with wall part 28.

To prevent the vibrations—caused, e.g., by the impact mechanism of the machine tool—of housing 4 from being transferred to C-shaped handle 10—the vibrations not only being perceived as uncomfortable by the operator but also possibly resulting in injury after long-term exposure—the two legs 20 of handle 10 are not guided directly in housing 4, nor are they connected directly with housing 4. Instead, their connection with housing 4 is established via a coupling element 44 or 46, which is hingedly connected to adjacent leg 20 or 22 and to housing 4, and which, together with helical compression spring 34, ensures that vibrations are decoupled between housing 4 and handle 10.

To prevent C-shaped handle 10—which is decoupled from housing 4—from tilting when moved from a rear end position in the direction toward the front end position when force F is applied to handle 10 on only one side or not parallel to working direction A, the motions of legs 20, 22 relative to housing 4 are synchronized. This takes place, according to the present invention, with the aid of connecting element 48, which connects the two coupling elements 44, 46 and ensures that the swivelling and rotary motion of coupling elements 44, 46 is synchronized and, therefore, that the linear motions of legs 20 and 22 of handle 10 hingedly connected to coupling elements 44 and 46 are synchronized.

Figure 2:
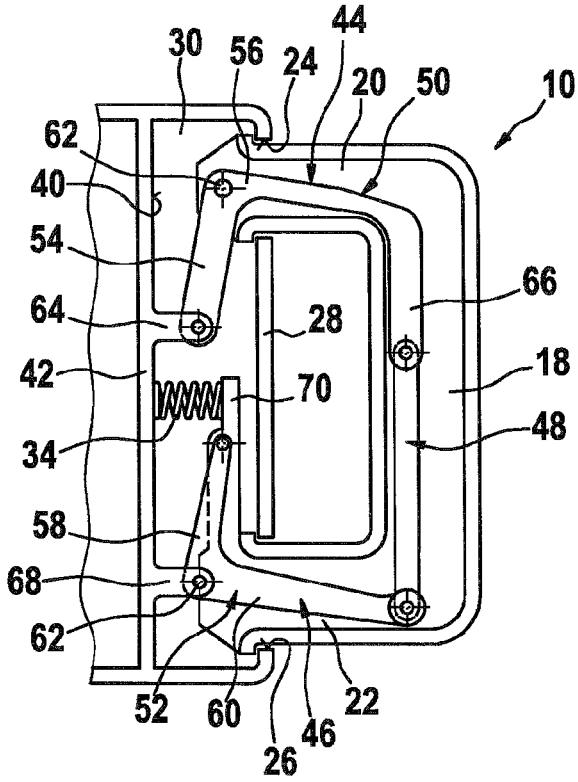
FIG. 2 shows a partially cut-away, enlarged side view of a rear grip region of the hand-held power tool in FIG. 1, with no force applied to the handle.
Figure 3:
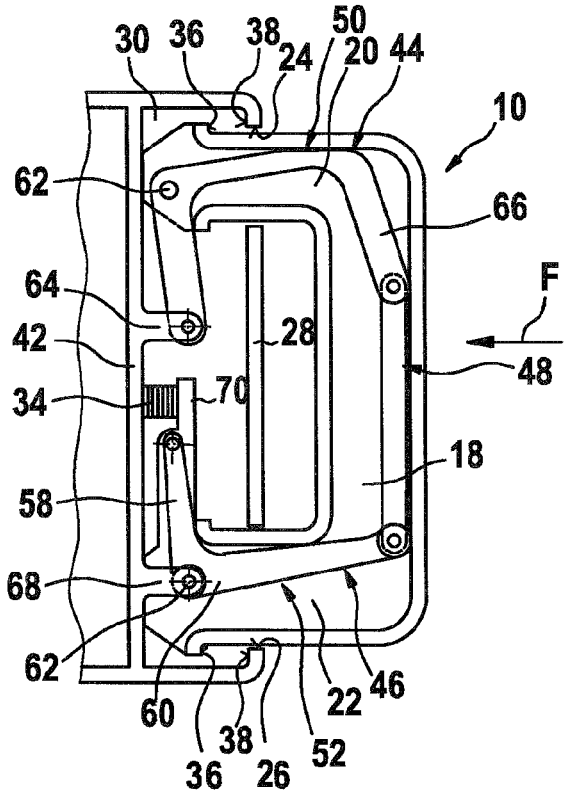
FIG. 3 shows a view similar to FIG. 2, but after the hand-held power tool has been pressed against a work piece, with a compressive force applied to the handle.

With the exemplary embodiment of machine tool 2 presented in FIGS. 2 and 3, which includes a hollow C-shaped handle 10 that is open at the ends of legs 20, 22, coupling elements 44, 46 are each composed of a two-armed lever 50, 52, whose two lever arms 54, 56 and 58, 60 are oriented at nearly right angles to each other near a pivot axis 62 of lever 50, 52. One lever arm 54 or 58 of each lever 50, 52 is located inside chamber 30, which is enclosed by grip region 32 of housing 4. When handle 10 is located in the center, lever arm 54 or 58 is located in the middle between the front and rear end positions, essentially perpendicular to working direction A of machine tool 2, while second lever arm 56 or 60 of each lever 50, 52 extends through the open end face of adjacent leg 20 or 22 into hollow handle 10, where the free ends of these lever arms 56, 60 are interconnected via connecting element 48, but not with handle 10 or housing 4.

Lever 50 (shown at the top in FIGS. 2 and 3) is pivotably connected via its pivot axis 62 at the free end of adjacent leg 20 of C-shaped handle 10, and at the free end of its lever arm 54 to a wall projection 64 of boundary wall 42. Lever arm 56 inside handle 10 is bent nearly parallel to lever arm 54 as it extends into hollow handle 10. Bent part 66 in the rear end position of C-shaped handle 10 is oriented nearly perpendicularly to working direction A. In contrast, the other lever 52 (shown at the bottom in FIGS. 2 and 3) is hingedly connected at its pivot axis 62 to an adjacent wall projection 68 of boundary wall 42. Its two lever arms 58, 60 are designed as straight lines, and lever arm 58 is pivotably and hingedly connected at a projection 70 of C-shaped handle 10 that extends perpendicularly to working direction A beyond the end face of leg 22 and into chamber 30, projection 70 serving simultaneously as a support bearing for the rear end face of helical compression spring 34.

Connecting element 48 has the shape of a longitudinally-extended, straight connecting rod, which is located in hollow yoke part 18 of C-shaped handle 10 and is oriented essentially perpendicular to working direction A of machine tool 2. Its opposing end faces are each hingedly connected with the free ends of lever arms 56 and 60 of levers 50 and 52. Pivot axes 62 of levers 50, 52 and the pivot joints at the free ends of lever arms 54, 56, 58, 60 are oriented perpendicularly to a plane passing through yoke 18 and legs 20, 22 of C-shaped handle 10.

The width of legs 20, 22 and yoke part 18 of handle 10 is adapted to the shape and dimensions of the two levers 50, 52 such that they may swivel—when C-shaped handle 10 moves—between the front and rear end positions inside chamber 30 and hollow handle 10 along a swivel path that corresponds to the path of travel of handle 10.

Figure 4:
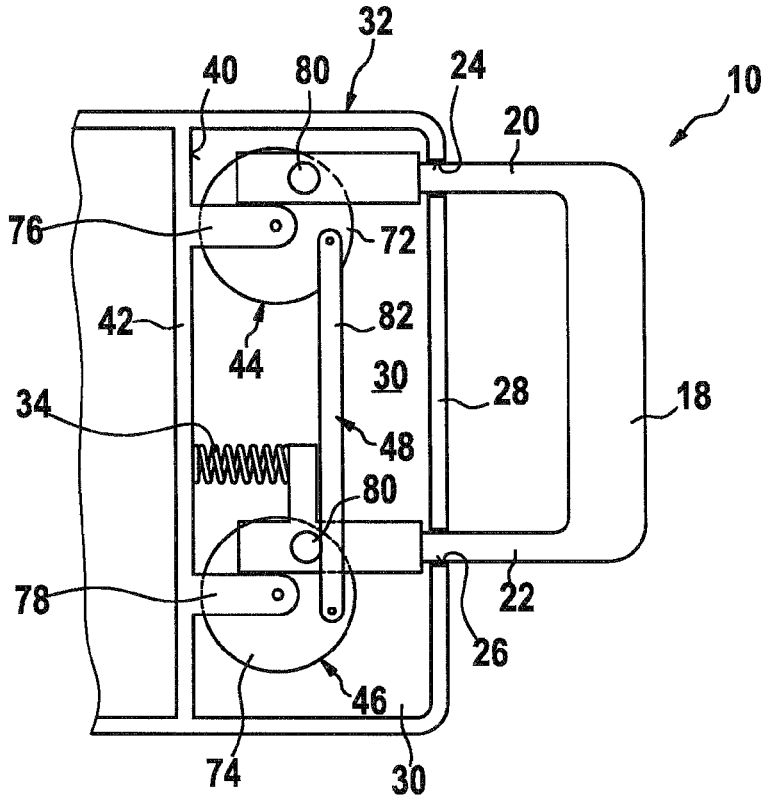
FIG. 4 shows a partially cut-away, enlarged side view of the rear grip region of another exemplary embodiment of the hand-held power tool, with no force applied to the handle.
Figure 5:
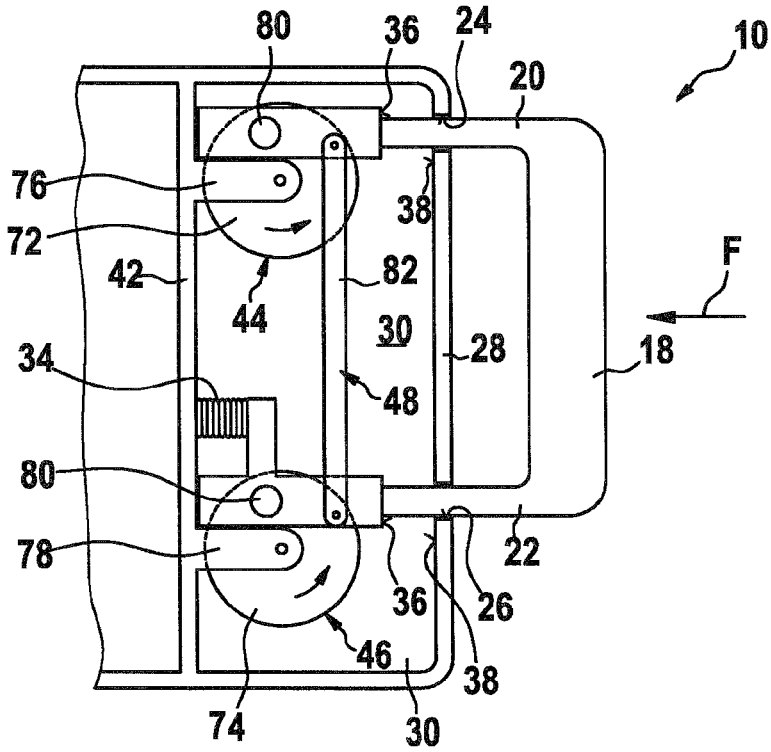
FIG. 5 shows a view similar to FIG. 4, but after the hand-held power tool has been pressed against a work piece, with a compressive force applied to the handle.
Figure 6:
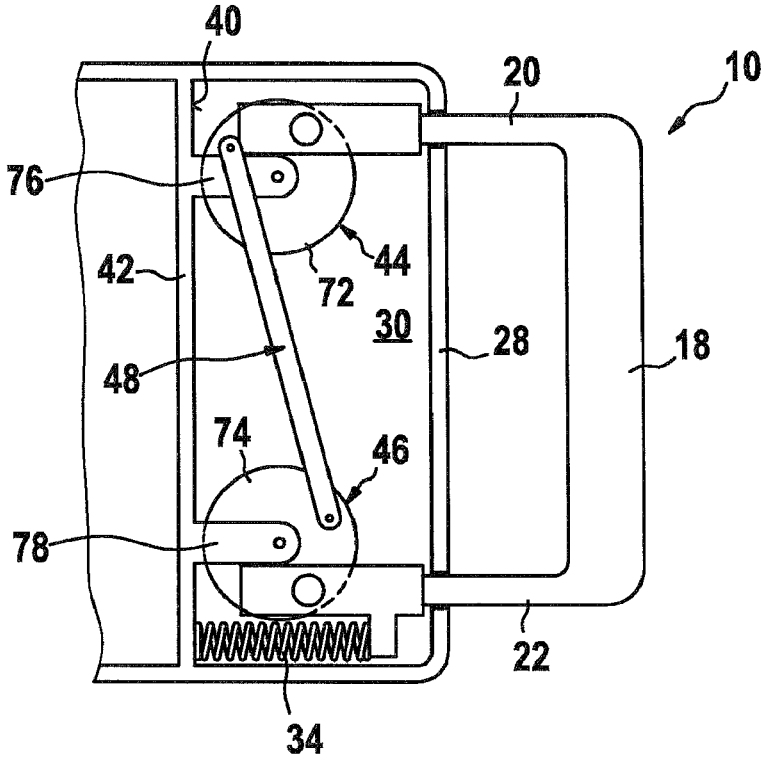
FIG. 6 shows a partially cut-away, enlarged side view of a rear grip region of a further exemplary embodiment of the hand-held power tool, with no force applied to the handle.

In contrast, in the exemplary embodiments of machine tool 2 with a solid C-shaped handle 10 depicted in FIGS. 4 through 6, coupling elements 44, 46 are designed as two circular disks 72 and 74, each of which is rotatably supported on a wall projection 76, 78 of boundary wall 42 adjacent to the inner side of leg 20 or 22, the rotation axes of disks 72, 74 extending through their centers. Both disks 72, 74 include—at a radial distance from their centers—a pivot pin 80 that extends over a broadside surface, and that rotatably engages in a complementary bore in adjacent leg 20 or 22 located near the free end.

The two disks 72, 74 are coupled via connecting element 48 such that a swiveling or rotary motion of one disk 72 or 74 results in a corresponding swiveling or rotary motion of the other disk 74 or 72, i.e., a rotation around a related swivel angle. In this case as well, connecting element 48 is designed as a straight, longitudinally extended connecting rod 82, the opposite end faces of which are hingedly connected to disks 72 and 74 and, in fact, at a radial distance from the center of disks 72, 74, and at an angular distance of approximately 90 degrees from pivot pin 80. In this case as well, the rotation axes of disks 72, 74 and the pivot axes of pivot pins 80 and the pivot points of connecting rod 82 on disks 72, 74 are perpendicular to a plane that passes through C-shaped handle 10.

Figure 7:
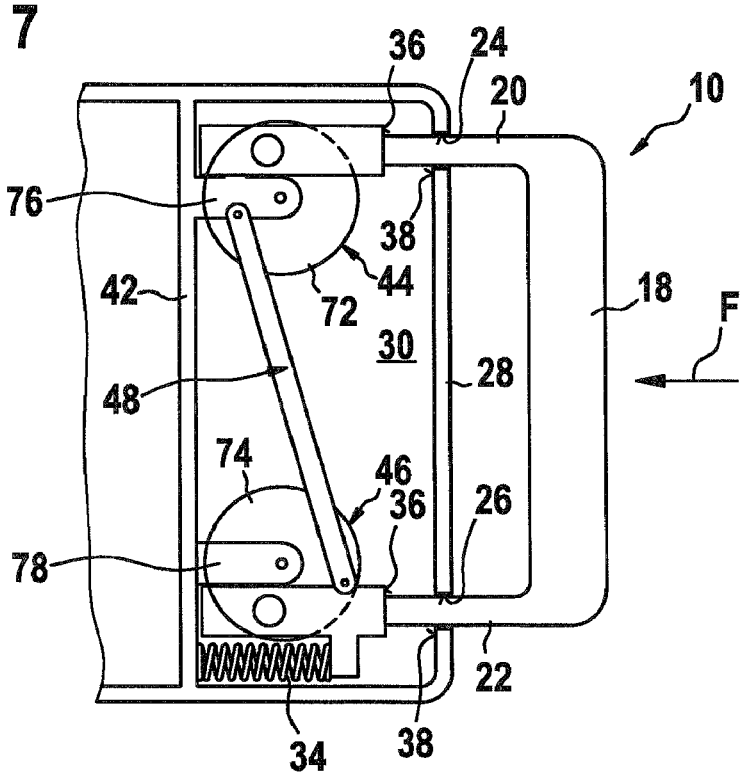
FIG. 7 shows a view similar to FIG. 6, but after the hand-held power tool has been pressed against a work piece, with a compressive force applied to the handle.

While connecting rod 82 in the exemplary embodiment shown in FIGS. 4 and 5 is oriented perpendicularly to working direction A of machine tool 2—its pivot points being located on the two disks 72, 74 behind the center of disks 72, 74, as viewed in working direction A of machine tool 2—in the exemplary embodiment shown in FIGS. 6 and 7, connecting rod 82 is slanted at a shallow angle toward working direction A of the machine tool. As viewed in working direction A of machine tool 2, one of the end faces of connecting rod 82 is located in front of the center of adjacent disk 72, and the other is located behind the center of adjacent disk 74.

In both cases, the pivot points of connecting rod 82 on disks 72, 74 move—when C-shaped handle 10 moves—between its two end positions along a trajectory that is nearly perpendicular to working direction A or machine tool 2, and they are displaced toward opposite sides of wall projections 76 and 78. In contrast, pivot pins 80 move along a trajectory that is nearly parallel to the working direction of machine tool 2.

What is claimed is:

1. A hand-held power tool, in particular selected from the group consisting of a rotary hammer, a percussion hammer, and both, with a housing and a vibration-damped handle that is spring-supported against the housing, with two essentially parallel legs, and a coupling element that is located between each leg and the housing and is hingedly connected with the leg and the housing, wherein the coupling elements (44, 46) are interconnected via a connecting element (48) that synchronizes pivotal motions of the coupling elements (44, 46) relative to the legs and to the housing, and wherein the connecting element (48) is not connected with an element selected from the group consisting of the housing (4) and the handle (10), wherein said connecting element (48) is a longitudinally extending connecting rod oriented substantially transverse to a working direction of the power tool, having opposite ends hingedly connected to the coupling elements (44, 46), and moveable along its longitudinal extension relative to said housing and relative to said handle transversely to said legs.

2. The hand-held power tool as recited in claim 1, wherein the connecting element (48) is oriented essentially transverse to a working direction (A) of the machine tool (2).

3. The hand-held power tool as recited in claim 1, wherein opposite ends of the connecting element (48) are hingedly connected to the coupling elements (44, 46).

4. The hand-held power tool as recited in claim 1, wherein the connecting element (48) is located inside the hollow handle (10).

5. The hand-held power tool as recited in claim 4, wherein at least one of the coupling elements (44, 46) extends through an open end of a leg (20, 22) into the hollow interior of the handle (10).

6. The hand-held power tool as recited in claim 1, characterized by at least one compression spring (34) located between the handle (10) and the housing (4).

7. A hand-held power tool, in particular selected from the group consisting of a rotary hammer, a percussion hammer, and both, with a housing and a vibration-damped handle that is spring-supported against the housing, with two essentially parallel legs, and a coupling element that is located between each leg and the housing and is hingedly connected with the leg and the housing, wherein the coupling elements (44, 46) are interconnected via a connecting element (48) that synchronizes the motions of the coupling elements (44, 46), wherein at least one coupling element (44) is designed as a two-armed lever (50), whose one lever arm (54) is hingedly connected with the housing (4), and whose other lever arm (56) is hingedly connected with the connecting element (48), the lever (50) between the two lever arms (54, 56) being hingedly connected with a leg (20) of the handle (10).

8. A hand-held power tool, in particular selected from the group consisting of a rotary hammer, a percussion hammer, and both, with a housing and a vibration-damped handle that is spring-supported against the housing, with two essentially parallel legs, and a coupling element that is located between each leg and the housing and is hingedly connected with the leg and the housing, wherein the coupling elements (44, 46) are interconnected via a connecting element (48) that synchronizes the motions of the coupling elements (44, 46), wherein at least one coupling element (46) is designed as a two-armed lever (52), whose one lever arm (58) is hingedly connected with a leg (22) of the handle (10), and whose other lever arm (60) is hingedly connected with the connecting element (48), the lever (52) between the two lever arms (58, 60) being hingedly connected with the housing (4).

9. A hand-held power tool, in particular selected from the group consisting of a rotary hammer, a percussion hammer, and both, with a housing and a vibration-damped handle that is spring-supported against the housing, with two essentially parallel legs, and a coupling element that is located between each leg and the housing and is hingedly connected with the leg and the housing, wherein the coupling elements (44, 46) are interconnected via a connecting element (48) that synchronizes the motions of the coupling elements (44, 46), wherein at least one coupling element (44, 46) is designed as a disk (72, 74) that is pivotably connected at its center with the housing (4) and that, at a distance from its center, is hingedly connected with one of the legs (20, 22) and the connecting element (48).

* * * * *